US005458166A

United States Patent [19]

Kronseder

[11] Patent Number: 5,458,166

[45] Date of Patent: Oct. 17, 1995

[54] CLEANSING SYSTEM FOR A CONTAINER TREATING MACHINE

[76] Inventor: Hermann Kronseder, Regensburger Strasse 42, 93086 Worth/Donau, Germany

[21] Appl. No.: 224,757

[22] Filed: Apr. 8, 1994

[30] Foreign Application Priority Data

Apr. 23, 1993 [DE] Germany ..... 9306138 U

[51] Int. Cl.[6] ..... B65B 1/04; B65B 3/04

[52] U.S. Cl. ..... 141/89; 141/91; 141/97; 134/153; 134/169 R; 134/199

[58] Field of Search ..... 141/97, 85, 89–92, 141/129; 134/153, 169 R, 199

[56] References Cited

U.S. PATENT DOCUMENTS

| | | | |
|---|---|---|---|
| 3,430,639 | 3/1969 | Roberts | 141/91 X |
| 3,789,889 | 2/1974 | Riedel et al. | 141/90 X |
| 3,907,011 | 9/1975 | Edmunds | 141/92 |
| 3,912,535 | 10/1975 | Rauser | 141/90 X |
| 4,197,000 | 4/1980 | Blackwood | 134/153 X |
| 4,602,964 | 7/1986 | Harchadour | 141/91 X |
| 4,605,047 | 8/1986 | Bausch et al. | 141/85 X |
| 4,779,782 | 4/1988 | Noulie | 134/153 X |
| 5,038,809 | 8/1991 | Rodgers et al. | 134/153 X |
| 5,217,538 | 6/1993 | Bucholz et al. | 134/153 X |

FOREIGN PATENT DOCUMENTS

| | | | |
|---|---|---|---|
| 4142331 | 7/1993 | Germany | 141/85 |

*Primary Examiner*—Henry J. Recla
*Assistant Examiner*—Steven O. Douglas
*Attorney, Agent, or Firm*—Ryan, Maki & Hohenfeldt

[57] ABSTRACT

A conduit system for spraying cleansing and rinsing liquids on a machine for processing containers such as bottles has vertical conduit columns arranged around the machine with liquid infeed conduits confluent with the lower end of at least some of the conduit columns and opposite ends of the infeed conduits are closed by welding to a support plate that is bolted in non-interfering locations to the legs of a machine table below the level of the bottle transporting rotor. Further support for the conduit columns is obtained with pipe arms that do not conduct liquid but have opposite ends welded to the support plate and to the conduit column, respectively. Conduit struts connect between uppers ends of the conduit columns. The conduits have a series of nozzles aimed for spraying all regions of the machine that must be cleansed and sterilized intermittently or continuously. Swingable wall sections are arranged to confine cleansing liquid to the machine area and other swingable walls serve to intersect splinters that may be propelled from bottles that are shattered by excessive air purging carbon dioxide gas pressure.

12 Claims, 3 Drawing Sheets

CLEANSING SYSTEM FOR A CONTAINER TREATING MACHINE

BACKGROUND OF THE INVENTION

The invention disclosed herein pertains generally to machines for treating containers such as bottles and particularly to cleansing systems associated with such machines.

For convenience, the word "bottles" is used herein as a name for bottles, cans and other kinds of vessels. In known bottle filling machines a conduit system is provided with nozzles for spraying, cleansing and sterilizing liquids onto the machine. The conduits are supported from a framework or other supporting structure. The cleansing liquid is fed to the conduits through flexible tubes that are connected to a pump. The large number of conduits and the supporting framework or other structure make visual and physical access to the machine difficult. Moreover, it is difficult to cleanse the inside and outside of the machine and the conduits and the framework supporting the conduits.

SUMMARY OF THE INVENTION

According to the invention, the problems mentioned above are obviated by providing a cleansing system wherein the conduits for the cleansing liquids are mostly self-supporting so that the frame employed in existing systems is eliminated. Thus, besides the advantage of a more economical and simple structure, the machine has improved aesthetic qualities and is much more accessible from the outside.

How the foregoing objectives and features of the invention are implemented will be evident in the more detailed description of the invention which will now be set forth in reference to the drawings.

DESCRIPTION OF A PREFERRED EMBODIMENT

Figure 1:
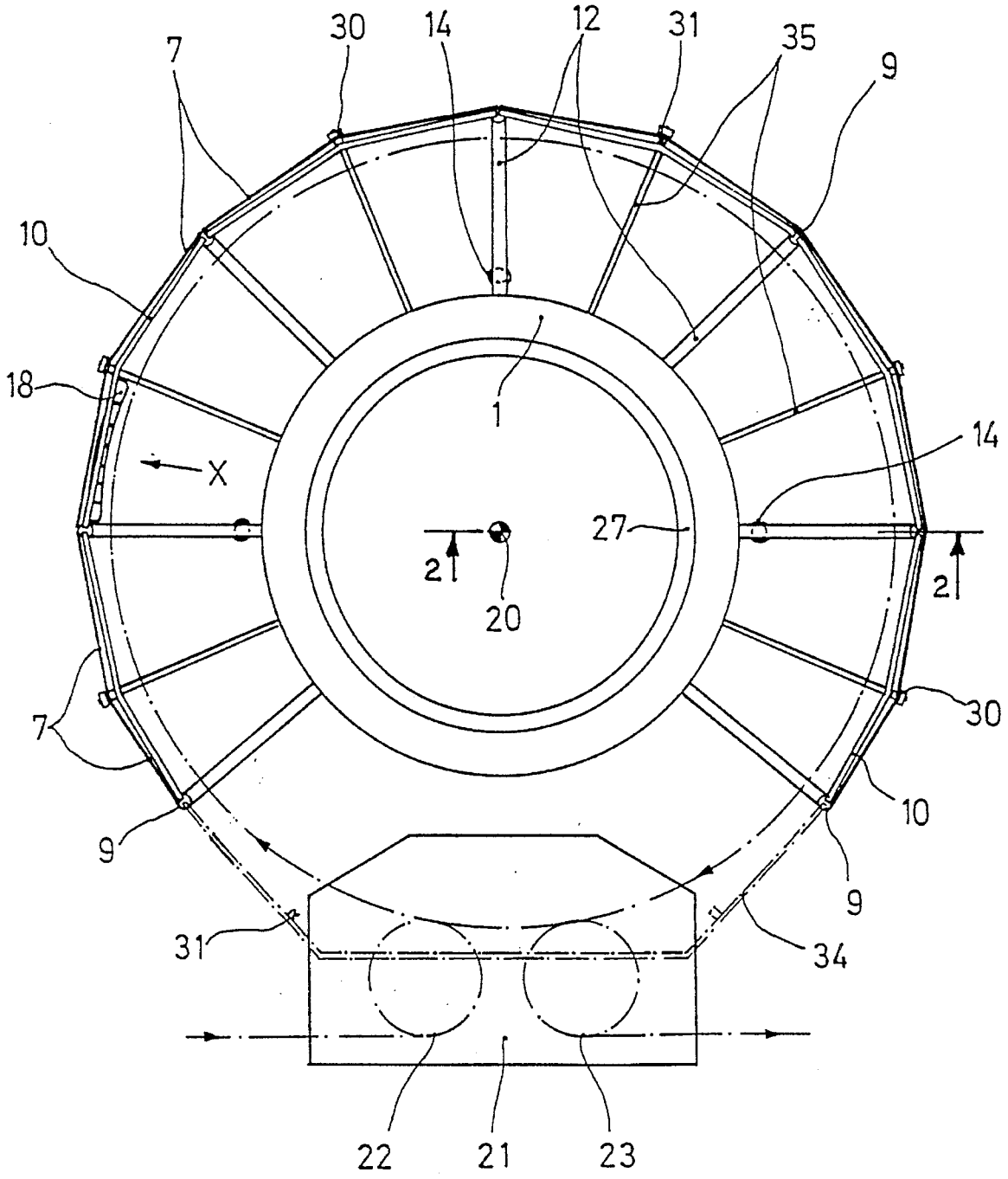
FIG. 1 is a plan view of a bottle filling machine with the normally superimposed rotor removed.
Figure 2:
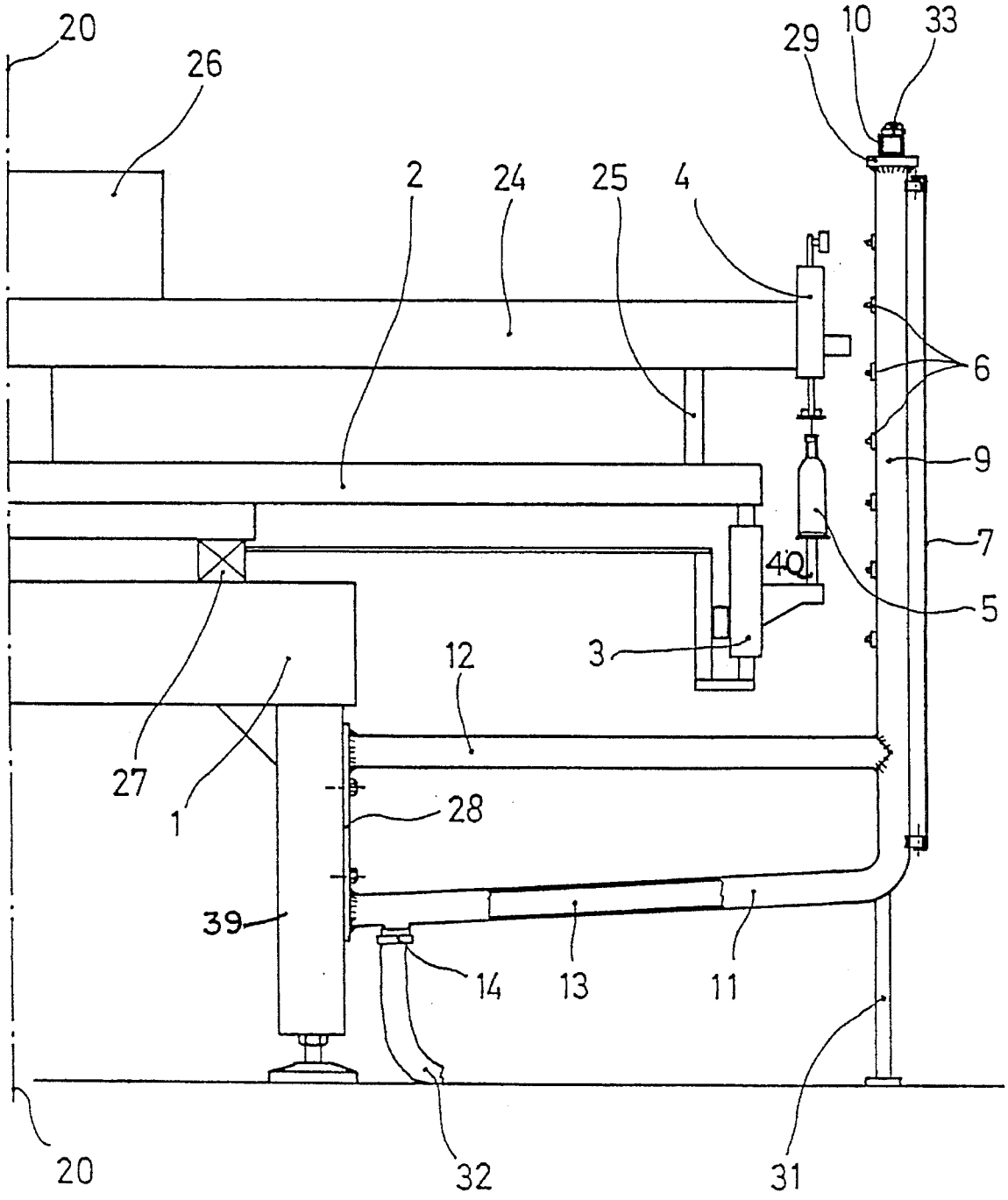
FIG. 2 is a vertical sectional view of the filling machine with the rotor installed, the section being taken on a line corresponding with 2—2 in FIG. 1.
Figure 3:
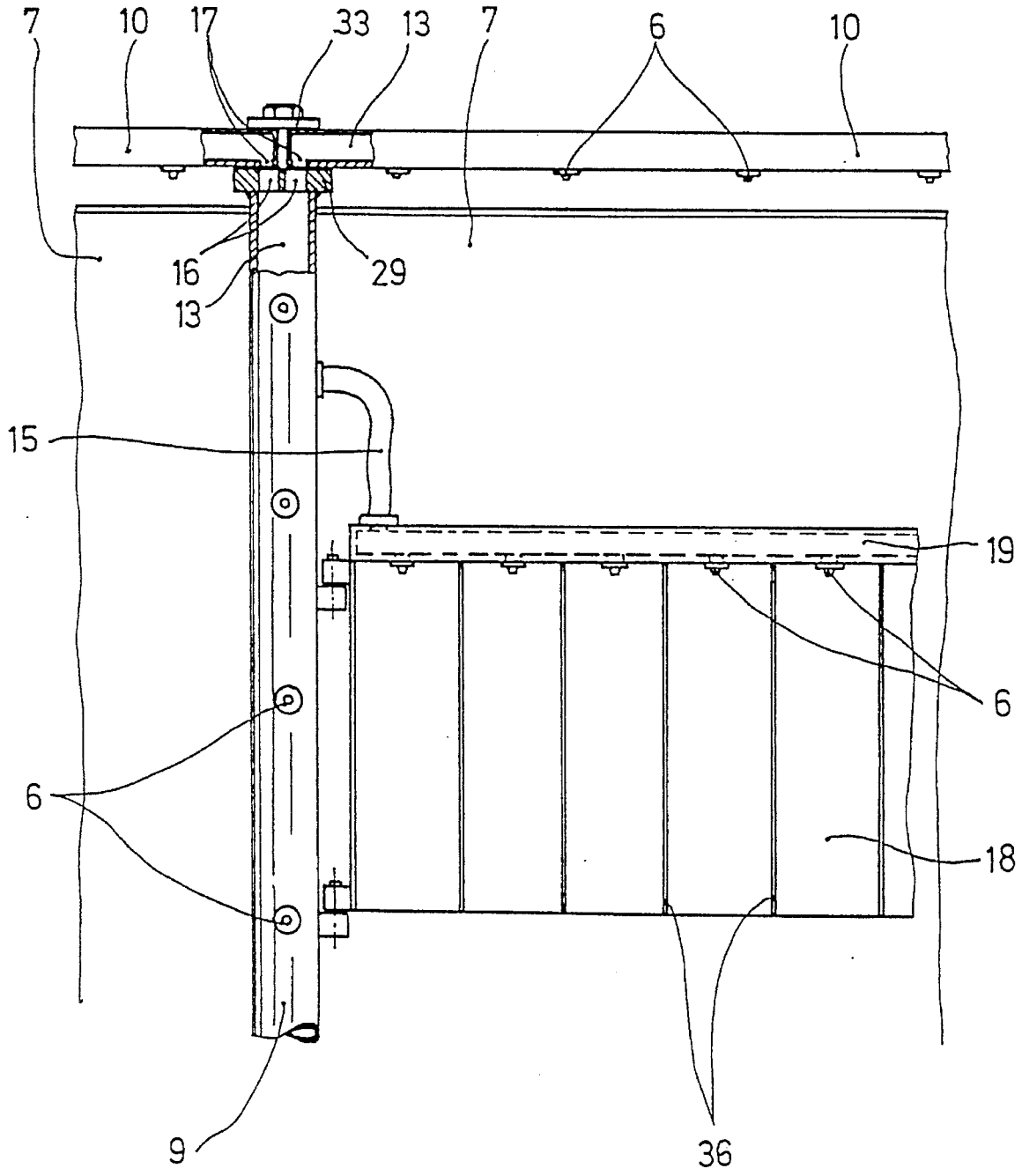
FIG. 3 is a view taken in the direction of the arrows 3—3 in FIG. 1 but is on a larger scale than corresponding parts in FIG. 2.

The machine depicted in FIGS. 1–3 is adapted for filling bottles 5 with a carbon dioxide containing beverage under sanitary conditions The machine comprises a stationary stand 1 that supports a large ring bearing 27. A circular rotor 2 bears on bearing 27 to provide for the rotor rotating about a vertical axis 20. The rotor supports a plurality of circumferentially spaced apart bottle elevating and lowering devices 3. In FIG. 2, a bottle 5 is presently standing on a rotatable plate 40, although bottles are not ordinarily present during performance of a cleansing operation. Directly above the bottle supports 40, there are correspondingly positioned bottle filling units 4 of a type that can be found in filling machines of various manufacturers. The devices 3 lift the bottles up to the filling unit 4 for being filled and then the bottles, after having been carried through a predetermined rotational angle are discharged from the machine. As shown in FIG. 1, bottles are fed into the machine by means of a conventional infeed starwheel 22, and the filled bottles are discharged from the machine through an outflow starwheel 23. Both starwheels are supported for rotation on a front table 21. The infeed starwheel 22 and the outfeed starwheel 23 are driven synchronously with the rotor 2 by a driving system, not shown.

On the top side of rotor 2, there is arranged a multiple chamber annular tank 24, variously called a kettle or bowl, for storing the beverage used to fill the bottles, and containing various process gasses such as steam and carbon dioxide. Tank 24 is adjustable in height by means of several spindles or jacks 25. The previously mentioned bottle filling units 4 are mounted to the periphery of the tank 24. Filling units 4 may be controlled electronically by devices, not shown, in a housing 26 arranged on the top of rotor 2.

FIG. 2 shows one of the seven vertical conduit columns 9 which are used in the illustrated new cleansing system and are the main supports for a conduit network. Conduits 9 have a vertical series of cleansing fluid spray nozzles 6. The lower end of each conduit column 9 is confluent with a cleansing fluid infeed conduit 11 which is hollow as indicated where the lead line of the numeral 13 is applied. Conduit 11, at its left end, is welded to a mounting plate 28 which is, in turn, fastened to table leg 39. Conduit 11 is pitched downwardly to provide fop draining residual cleansing liquid out of the system after a cleansing operation is completed. Conduit 11 participates in supporting conduit column 9. Additional support is obtained by means of pipes 12 whose opposite ends are Welded to the mounting plate 28 and conduit column 9, respectively. Fluid having cleansing and sterilizing properties is fed into conduit 11 by means of a hose 32, which is shown fragmentarily in FIG. 2 and which connects to conduit 11 with a coupling 14. FIG. 1 shows that there are three different places where cleansing fluid is fed into the system through couplings 14.

The system comprises the seven vertical conduit columns 9 which are tied in, not only with horizontal conduit 11 and pipe 12, but in addition, the upper ends of the columns 9 are interconnected by means of tubular members 10 which fulfill the dual purposes of transverse stabilizing struts and conduits for cleansing fluid. Uppermost conduit sections 10 are bent slightly in their central region to make them conform more closely to a sector of a circle. The conduit sections 10 extend between the upper ends of the vertical conduit columns 9 and they receive cleansing liquid from conduits 9 through outlet ports 16 in disks 29 and inlets 17 in the conduits 10. The six horizontal strut conduits 10 together nearly circle the entire periphery of rotor 2 except for a small distance in the region of front table 21. The vertical conduit columns 9 all lie slightly radially outwardly from the rotor 2 with little clearance. As shown in FIGS. 2 and 3, the upper ends of conduit columns 9 are closed by fluid-tight cover disks 29. The conduit struts 10 are connected to the upper ends of columns 9 by means of clamps 33 which are screwed into the cover 29. Conduit struts 10 are rectangular in cross-section in the described embodiment.

The space between two adjacent conduit columns 9 is spanned by two rectangular protective guard walls 7 that are comprised of reinforced sheet metal plates arranged for swinging on columns 9. The protective walls 7 are secured in working position by bolts 30 which are arranged on vertical supports 31. Some support members 31 stand upright on the machine base and are joined by horizontal struts 35. They are fastened at their upper ends to transverse conduit struts 10.

The cleansing liquid spray nozzles 6 on vertical conduits 9 project cleansing liquid on rotor 2, annular tank 24, bottle carrying devices 3, and filler units 4. Thus, these parts can be sprayed, rinsed or disinfected and sanitized as needed.

The nozzles 6 on the horizontal conduit struts 10 direct cleansing liquids against the inside of protective walls 7 so the entire interior of the machine encircling protective wall can be sprayed periodically or continuously.

When the mouth of a bottle 5 is first coupled to a bottle filling unit 4, the bottle is filled with pressurized gas, such as carbon dioxide, such that the bottle may, on occasion, burst. Hence, inside of the protective wall 7 on column 9, there is a swingably articulated wall 18 for intercepting glass splinters if any occur. Protective wall 18 extends in height over the movement path of bottles 5 toward the outside and is provided with vertical stiffener ribs 36 as shown in FIG. 3. Protective wall 18 is supported on a tubular member 19 which is supplied with pressurized cleansing liquid from column 9 through a flexible hose 15 as depicted in FIG. 3. Supporting arm conduit 19 is provided on its underside with several spray nozzles 6. These nozzles are directed for purging splinter protection wall 18 continuously or intermittently during operation of the bottling machine.

If it is desired for the front table 21, the bottle infeed starwheel 22 and the outfeed 10 starwheel 23 to be subjected to spraying of cleansing fluid, then an additional multiple angled transverse conduit strut 34 is used as shown in dot-dashed lines in FIG. 1. Transverse conduit strut 34 is constructed similarly to the other conduit struts 10 and opposite ends of the conduit struts 34 are connected by suitable means to the next adjacent vertical conduit columns 9 in a manner previously described. Transverse conduit struts 34 are provided with nozzles, not visible, that are positioned for spraying the front side of the bottle filling machine.

In larger systems, it is desirable for all of the infeed conduits 11 or vertical column conduits 9 to have their own individual inlets 14 for pressurized cleansing liquid, instead of only three of the conduits 11 as suggested in FIG. 1. Feeding of the cleansing fluid to the individual columns 9 can be controlled individually or in common. It is possible, also, to feed different cleansing fluids to different columns 9. Control equipment, such as cams and cam followers, not shown, plates for controlling the bottle elevating and lowering units 3 may also be supported from the conduit network comprising the cleansing system.

I claim:

1. A cleansing system for container processing machines including bottle filling machines comprised of a stand and a horizontal table supported thereon, and a rotor mounted for rotation on and above the table, the rotor having arranged in circumferentially spaced apart relationship about its perimeter a plurality of container filling units, the cleansing system comprising:

a plurality of vertically extending conduit columns having upper ends, the columns being adapted to be arranged in spaced apart relation around a said machine, the conduit columns having liquid infeed passageways and having outfeed passageways at said upper ends and a series of nozzles for spraying pressurized cleansing liquid from inside of the conduit columns onto regions of the machine, and a plurality of liquid infeed conduits each having one end connected with the infeed passageway of at least some of the conduit columns, respectively and having an opposite end adapted to be sealed and fastened to a said machine for aiding in support of the respective conduit columns, and a liquid infeed line connected to the infeed conduit between its ends.

2. The cleansing system according to claim 1 wherein said liquid infeed conduits are approximately horizontal and their said opposite ends are adapted to be fastened to a said machine at a level below the level of the rotor.

3. The cleansing system according to claim 1 including a plurality of conduit struts having opposite ends and means for clamping one end of each conduit strut sealingly to a said upper end of a conduit column and the opposite end of the conduit strut to the upper end of another one of said spaced apart conduit columns, at least some of the conduit struts having a liquid inlet in communication with said upper end outfeed passageway of the conduit column on which the conduit strut is clamped, and a series of nozzles on the conduit struts for spraying pressurized liquid.

4. The cleansing system according to any one of claims 1, 2 or 3 wherein said infeed conduit is continuous with said vertical column conduit and has a portion bent at an angle for the portion to join the vertical conduit column axially.

5. The cleansing system according to any one of claims 1, 2 or 3 including an elongated rigid arm arranged approximately parallel to a said infeed conduit that supports a conduit column, said arm having opposite ends one of which is adapted to be fastened to said machine and the other of which is fastened to a conduit column for additional support of the conduit column.

6. The cleansing system according to claim 5 wherein said conduit column and said arm are hollow and have a circular cross section.

7. The cleansing system according to any one of claims 1, 2 or 3 including a protective wall mounted to at least some of said conduit columns for swinging about a vertical axis.

8. The cleansing system according to claim 3 wherein said conduit struts have a rectangular cross section.

9. The cleansing system according to claim 3 including a protective wall mounted to at least some of said conduit columns for swinging about a vertical axis and at least some of said nozzles on said conduit struts are directed for spraying liquid on said protective wall.

10. The cleansing system according to claim 1 including a splinter protection wall and means for mounting said splinter protection wall to at least one of said conduit columns for intercepting splinters emanating from a bursting bottle.

11. The cleansing system according to claim 10 wherein said means for mounting said splinter protection wall to said conduit column comprises pivot means for enabling said wall to swing about a vertical axis, a support conduit member extending along said wall in a radial direction relative to the vertical axis, and a flexible conduit having an inlet in communication with said conduit column and an outlet in communication with said support conduit member, and nozzles on said support conduit member for spraying liquid on the splinter protection wall.

12. The cleansing system according to claim 3 wherein said machine has a front table on which a container infeed star wheel and an outfeed starwheel are driven rotationally, and at least one of said conduit strut sections having nozzles adapted to be positioned over said front table.

* * * * *